US006269809B1

(12) United States Patent
Fleming

(10) Patent No.: US 6,269,809 B1
(45) **Date of Patent: *Aug. 7, 2001**

(54) LOW EMISSION FIREPLACE

(75) Inventor: John Stuart Fleming, Auckland (NZ)

(73) Assignee: Superior Fireplace Company, Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/557,053

(22) Filed: Apr. 21, 2000

Related U.S. Application Data

(60) Continuation of application No. 08/873,425, filed on Jun. 12, 1997, now Pat. No. 6,123,066, which is a division of application No. 08/509,426, filed on Jul. 31, 1995, now Pat. No. 5,678,534, which is a continuation of application No. 08/200,414, filed on Feb. 23, 1994, now abandoned.

(30) Foreign Application Priority Data

Feb. 23, 1993 (NZ) ..... 245975

(51) Int. Cl.[7] ..... F24C 5/00

(52) U.S. Cl. ..... 126/512; 126/92 R; 126/92 B; 431/125

(58) Field of Search ..... 126/512, 92 R, 126/92 AC, 92 B, 500, 552, 92 C, 553, 554, 93; 431/125; 110/203

(56) References Cited

U.S. PATENT DOCUMENTS

| | | | | |
|---|---|---|---|---|
| 1,618,477 | * | 2/1927 | Sala | 126/92 AC |
| 1,621,135 | * | 3/1927 | Sala | 126/92 AC |
| 1,703,459 | * | 2/1929 | Sala | 126/92 AC |
| 1,726,000 | * | 8/1929 | Sala | 126/92 AC |
| 1,752,007 | * | 3/1930 | Kline . | |
| 1,884,746 | * | 10/1932 | Kline et al. | 126/512 |
| 4,194,490 | * | 3/1980 | Crnkovic | 126/553 |
| 4,688,548 | * | 8/1987 | Stoughton | 126/553 |
| 4,691,686 | * | 9/1987 | Alvarez | 126/112 |
| 4,793,322 | * | 12/1988 | Shimek et al. | 126/512 |
| 4,919,120 | | 4/1990 | Hriokoshi et al. | 126/93 |
| 5,081,981 | * | 1/1992 | Beal | 126/512 |
| 5,127,392 | * | 7/1992 | Mizuno | 126/92 R |
| 5,139,011 | * | 8/1992 | Moon | 126/512 |
| 5,678,534 | * | 10/1997 | Fleming | 126/512 |

FOREIGN PATENT DOCUMENTS

| | | | | |
|---|---|---|---|---|
| 610285 | * | 2/1935 | (DE) | 126/552 |
| 2623881 | | 6/1989 | (FR) . | |
| 428393 | | 5/1935 | (GB) . | |
| 571924 | | 9/1945 | (GB) . | |
| 661919 | | 11/1951 | (GB) . | |
| 681840 | | 10/1952 | (GB) . | |
| 2081885 | * | 2/1982 | (GB) | 126/92 B |
| 2087542 | * | 5/1982 | (GB) | 126/553 |
| 2203532 | | 10/1988 | (GB) . | |
| 2216252 | | 10/1989 | (GB) . | |
| 2 203 532 | | 3/1991 | (GB) . | |
| 2203532 | | 3/1991 | (GB) . | |
| 2 216 252 | | 12/1991 | (GB) . | |
| 2216252 | | 12/1991 | (GB) . | |
| 2261942 | | 6/1993 | (GB) . | |
| 57-134616 | * | 8/1982 | (JP) . | |

* cited by examiner

*Primary Examiner*—Ira S. Lazarus
*Assistant Examiner*—Josiah C. Cocks
(74) *Attorney, Agent, or Firm*—Christie, Parker & Hale, LLP

(57) ABSTRACT

This invention relates to heating apparatus and particularly compact heating apparatus fuelled by a flammable fluid such as gas in which a visible flame is provided. The appearance of the visible flame and the fireplace setting within the heating apparatus is enhanced by the provision of a reflective means positioned behind the fuel assembly to reflect an image of the assembly and/or the flame towards a viewing port in the front of the heater. Additionally or alternatively, the heater apparatus provides an exhausting of the emissions of the primary combustion directly into the room in which the heater is housed to return much of the otherwise exhausted heat into the room. The exhaust is put through a secondary combustion chamber including or comprising a catalytic converter before being exhausted into the room.

9 Claims, 2 Drawing Sheets

10
7a
18
7
1
F
3
6
2
5
9
16
8
13
11
4
14
12
15
17
16

LOW EMISSION FIREPLACE

CROSS REFERENCE TO RELATED APPLICATION

This application is a continuation of patent application Ser. No. 08/873,425, filed Jun. 12, 1997, now U.S. Pat. No. 6,123,066, which is a divisional of patent application Ser. No. 08/509,426, filed Jul. 31, 1995, now U.S. Pat. No. 5,678,534, which is a continuation of patent application Ser. No. 08/200,414, filed on Feb. 23, 1994, now abandoned.

BACKGROUND OF THE INVENTION

1. Field of the Invention

This invention relates to a heating apparatus and more particularly to a compact heating apparatus, for example, a fuel heating apparatus such as a gas liquid or gel fuel enclosed or semi-enclosed in a heating apparatus incorporating a visible flame and/or a heating apparatus exhausting at least a portion of the emissions from the combustion into the room in which it is housed.

2. Description of the Invention

Traditionally there has been a need for a heating apparatus to provide a combination of heat and which preferably has the appearance of a traditional fireplace, without the difficulties and responsibilities which accompany traditional fireplaces. These requirements have resulted in, in some instances, fireplaces which are more conveniently fuelled with fuels such as oils, gel or gas, yet which provide artificial logs or coals to create the impression of a fireplace. While these heating apparatus overcome the inherent limitations of traditional fireplaces, yet retain the appearance of the traditional fireplace, in many instances there are severe limitations on their application in view of the bulk of such fireplaces.

In the past, where space is at a premium, visual flame heating apparatus have usually been made as shallow as possible to allow them to (a) fit into confined spaces, and (b) to minimise the quantity of material used and as such the cost of the apparatus.

One of the main factors limiting the extent to which a heating apparatus can be reduced in depth is the depth requirement required to approximate the depth of a traditional wood or coal fire with artificial logs or coals in a manner to make the apparatus visually acceptable. This problem is particularly evident in a heating apparatus which employs, for example, two main artificial logs positioned substantially horizontally one behind the other on a grate or base as these units are usually of a similar depth to a traditional fire.

In the past a, heating apparatus incorporating visual flame characteristics and an artificial log or coal "fire" of a narrower depth than traditional coal or wood fires have not been able to attract a significant share of the market.

There is also a need in the marketplace to provide heating apparatus which are able to be mounted for operation close to a wall or other portion of the building and in certain circumstances placed within the wall cavity of a building, to reduce the outward projection of the heating apparatus into a room.

A particular difficulty of heater projection arises in small rooms, hallways, hotel rooms and the like, however, it has been found that in view of the close proximity of the heat source particularly to the rear of a casing for a shallow heating apparatus, there are increased problems of heat transfer from a casing of the heater, thus limiting the extent to which such heating apparatus can be close mounted or recessed into a building wall, particularly when such wall incorporates flammable material.

Another difficulty in the provision of heating apparatus is the normal requirement to provide a flue to an air space external of the room in which the heater is mounted so as to exhaust the emissions from the combustion. Residual gases and carbon monoxide and other contaminate levels in these emissions such as residual unburnt hydrocarbons creating an unpleasant smell may be too high to be normally exhausted into the room in which the unit is housed. The provision of the flue not only adds difficulties in fitting a unit to an existing room or building, but also exhausts a large quantity of heating out through the flue to the external airspace.

It is an object of this invention to over come the mentioned problems or at least provide the public with a useful choice.

Other aspects of this invention will become apparent from the following description.

SUMMARY OF THE INVENTION

According to one aspect of this invention there is a provided a burner means for a heater including an actual or artificial fuel assembly, outlet means for providing a flame about or adjacent said fuel assembly, a reflective means positioned behind said fuel assembly to reflect an image of at least part of said fuel assembly and/or said flame visible from the front of said burner means.

According to a further aspect of this invention the reflective means is a sheet of reflective material oriented in relation to remaining portions of the apparatus to reflect an image of at least portions of said fuel assembly and/or flame to the front of said burner means to increase the apparent depth of the fuel assembly and/or flame to a viewer.

According to a still further aspect of this invention, the reflective means is mounted to a support such that upon thermoexpansive heating of said sheet, said sheet bends in at least one plane to reflect a visually reduced or enlarged image of the portions of said fuel assembly or flame to a front of said burner means.

Accordingly, in a further aspect, the invention consists of a heating apparatus comprising a primary combustion chamber;

a flammable fluid supplied to said primary combustion chamber;

an air inlet into said primary combustion chamber;

a secondary combustion chamber in communication with said primary combustion chamber;

a catalytic converter within or forming said secondary combustion chamber; and an exhaust port in communication with said secondary combustion chamber such that the flammable fluid supplied to said heater is combusted first in the primary combustion chamber and at least a portion of the products of the primary combustion further combusted in the catalytic converter before exiting through the exhaust port.

Other aspects of this invention which should be considered in all their novel aspects will become apparent from the following description.

One the form of the invention will now be described with reference to the accompanying drawings,

DETAILED DESCRIPTION OF EXEMPLARY EMBODIMENTS

Figure 1:
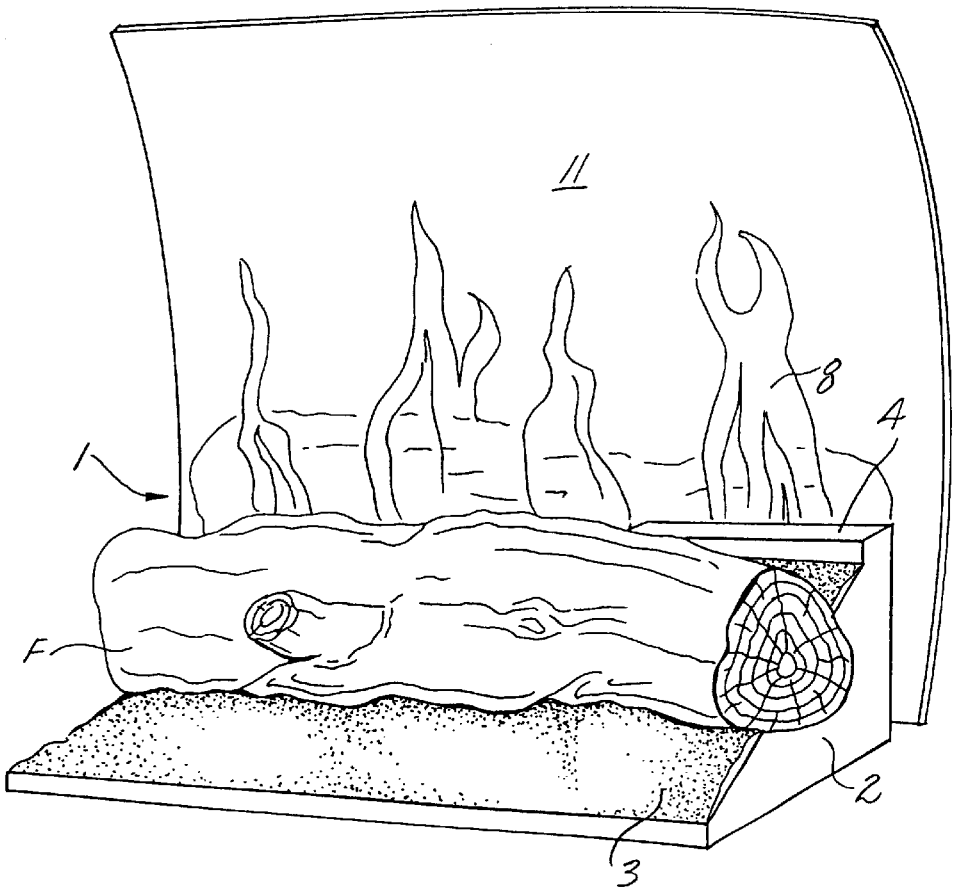
FIG. 1 is a substantially schematic view of the burner apparatus according to the invention in a substantially perspective view.
Figure 2:
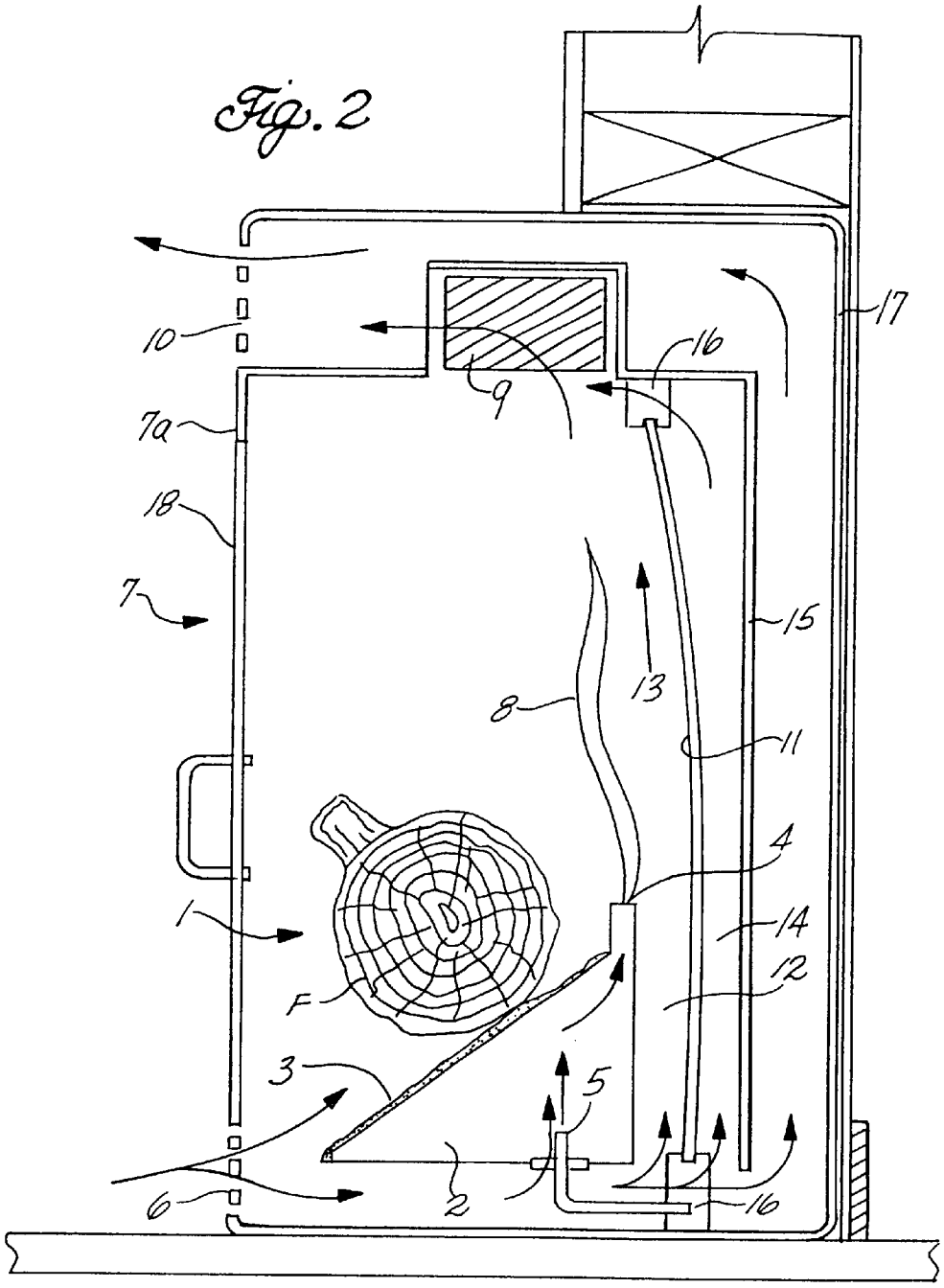
FIG. 2 is a substantially schematic cross-sectional side view of a typical heater apparatus incorporating the burner means of FIG. 1 showing the heating apparatus positioned in a recess within a building wall.

With reference to FIGS. 1 and 2, the burner assembly as generally indicated by arrow 1 is preferably arranged for fuelling with gas, for example LPG or natural gas. Further, portions of the apparatus are preferably provided in substantially heat resistant material such as sheet metal, for example stainless, surface treated mild steel and the like.

While the invention is described with reference to gas fuelling or a flammable fluid, the invention is not limited thereto, and the invention is applicable across a wide range of fuel types.

The burner apparatus 1 preferably includes a burner housing 2 which is preferably formed in sheet steel and provides an inclined front face 3 which is, in the preferred form of the invention, arranged in a bed of vermiculite or other material which may in certain circumstances provide the appearance of embers, particularly when percolated with gas.

The housing 2 preferably incorporates a fuel assembly F which is provided as an artificial log, for example formed in a ceramic material and the like according to substantially known techniques.

In the preferred form, the fuel assembly is mounted substantially horizontally across a frontal portion of the housing 2 and adjacent a flame outlet 4 which is positioned at a level substantially below upper portions of the artificial log such that it is substantially hidden from view in a normal line of sight.

With reference to FIG. 2, it will be seen that the housing 2 is fed with gas from a gas outlet 5 and also draws air to assist burning of said gas from an inlet 6 in a heater housing generally indicated by arrow 7 such that upon ignition, a flame 8 preferably emanates as a sheet of flame in a substantially natural manner from the outlet 4, substantially adjacent the fuel assembly F. In the preferred form of the invention, and with reference to FIG. 2, an exhaust pathway is provided via a catalytic convertor 9 to an outlet 10 in the heater casing 7.

A reflective means 11 is provided behind the burner outlet 4 and the fuel assembly F. In the preferred form, the reflective means 11 is provided as a sheet of polished stainless steel of a width substantially commensurate with a back of the heater casing 7. The reflectorized sheet 11 is oriented to reflect, according to a range of normal lines-of-sight, an image of said flames and portions of said fuel assembly F to thus create an increased apparent depth and in this embodiment, an increase in the apparent number of logs.

Preferably the reflective sheet 11 is spaced rearwardly from the burner housing 2 to provide an air pathway 12 therebetween and to maintain the reflective surface of the sheet 11 substantially spaced in use from the flame 8 by a curtain of air 13 which passes from a lower portion thereof upwardly across the reflective face of the sheet 11. Preferably a further air pathway 14 is preferably provided behind said reflective sheet 11 so as to enable a convection air flow between a rear wall 15 of a firebox 7*a* for the heating arrangement and the reflective sheet 11, so as to maintain a relatively controlled temperature of said reflective sheet 11 and to reduce heat transfer from the vicinity of said reflective sheet 11 rearwardly of the heater.

Preferably the reflective sheet 11 is securely mounted between upper and lower adjustable mounting blocks 16 to remaining portions of the heater and the dimensions of said reflective sheet 11 are such that the surface of the reflective sheet 11 is retained in a curved, preferably outwardly concave shape so that the image reflected by reflective sheet 11 is dimensionally different, and preferably slightly smaller than the flames and fuel assembly F seen when viewed from the front of the heater. This visually enforces the increased apparent depth of the fuel assembly and flames.

It is also envisaged that precurvature of the reflective sheet 11 reduces a likelihood that the reflective sheet 11 will develop ripples under the effects of thermo expansion as a result of heating from close proximity to the flames 8.

In the preferred form of the invention, the firebox rear wall 15 is preferably spaced from an outer casing 17 of the heater to additionally provide an air convection pathway therebetween.

The air convection pathway passes from the inlet 6 to the outlet 10 outside the firebox 7 and it will be appreciated that effectively three air convection pathways are provided (1) forwardly of said reflective sheet 11, (2) behind said reflective sheet 11, and (3) rearwardly of the firebox rear wall 15 provide an enhanced ability for transfer of heat in the region of those convection pathways out of the heater outlet 10 to reduce heat transmission to surrounding surfaces, for example, wall construction surfaces adjacent the heater casing 7.

In the preferred form of the invention, preferably the heater casing also incorporates an openable frontal door 18, although this is in no way essential to the invention. In one form of the invention, preferably the frontal door 18 is provided to be semi-reflectorized to provide multiple reflected images between the reflective sheet and the frontal door 18 for enhanced visual effect.

In view of the depth of the apparatus being substantially less than a substantially equivalent product not incorporating the reflective surface, the apparatus can be constructed at a reduced cost.

It should be noted that the apparatus as shown in FIG. 2 comprise a flue or exhaust port 10 which directs emissions from the combustion directly into the room in which the heater is housed. The main fire box of the heater may be used as a primary combustion chamber and a secondary combustion chamber may be provided which includes, or in this case comprises, a catalytic converter 9. The provision of the catalytic converter to provide secondary combustion allows the emissions from the primary combustion chamber to be exhausted into the room without undesirable levels of carbon monoxide or unburnt hydrocarbons. This is particularly difficult to achieve when trying to provide a visual flame as opposed to the cleaner burning blue or invisible flames.

The catalytic converter 9 used in the secondary combustion chamber should be chosen to provide a suitable flow through to exhaust either the entire products of combustion or a portion of those products should an alternative exhaust flue be provided. This flow through the catalytic converter 9 must be balanced against the input of flammable fluid and the oxygen levels to ensure a properly visible flame is provided.

A suitable catalytic converter has been found to be a CORNING 7×2 catalytic converter which provides a suitable flow at an input rate of fuel of 12 to 14 MJ/h. This has been found suitable for this particular embodiment although other converters and input rates could be used.

It should be noted that the option of passing only a portion of the exhaust through the catalytic converter may be used where it is desired to return at least a portion of the heated air back into the room to improve the heating achieved by the apparatus and this may be done even when an external flue is provided to transport the remainder of the exhaust gases to an external air space. This external flue may take a flow of exhaust either prior or subsequent to the catalytic converter.

For the catalytic converter to operate efficiently, a minimum temperature is necessary in the area surrounding the catalytic converter. Generally, a minimum temperature of greater than 200° C. is required for the efficient operation of the catalytic converter 9 and it has been found that a working temperature of about 240° C. or greater is particularly suitable. To achieve this temperature, the heater housing and exhaust port must be constructed so as to provide a large quantity of heat to the area surrounding the catalytic converter 9 and as can be shown in the embodiment in FIG. 2, the provision of the catalytic converter 9 directly adjacent at the top of the primary combustion chamber will allow sufficient heat from the primary combustion chamber to be used to provide the correct operating temperature for the catalytic converter 9.

It has also been found that in order to get a large anaesthetically acceptable flame height, the oxygen percentage in the flue gases should be in the range of 2% to 10%. This is particularly important on smaller sized units which use less input of flammable fluid.

Thus it will be appreciated that one embodiment of the apparatus provides for a burner or heater apparatus which facilitates the exhausting of emissions directly into the room in which the heater is housed to improve the heat produced by that heater into the room as well as perhaps making the provision of an external flue unnecessary and thereby reducing costs in fitting such apparatus.

Thus it will be appreciated the apparatus provides for a burner/heating apparatus which facilitates a visual flame having the apparent depth of a much deeper arrangement, and which incorporates convection pathways which reduce heat transfer rearwardly of the heater casing to facilitate mounting of the apparatus in a convenient and compact manner.

What is claimed is:

1. A gas log fireplace comprising:

a housing having a top wall, bottom wall, side walls and a rear wall;

a firebox within the housing comprising a top wall, rear wall and side walls, said firebox forming a primary combustion chamber;

a room air plenum comprising a top room air plenum between the top wall of the firebox and the top wall of the housing, a rear room air plenum between the rear wall of the firebox and the rear wall of the housing in communication with the top room air plenum;

an inlet opening for allowing room air to enter the rear room air plenum;

an outlet opening in communication with the top room air plenum for allowing room air and exhaust products in the top room air plenum to be exhausted into a room in which the fireplace is situated;

an intake opening into the firebox for receiving room air into the primary combustion chamber;

a support surface within the firebox;

a burner within the firebox and at least one artificial log mounted on the support surface within the firebox adjacent to said burner;

a gas outlet delivering combustible gas to the burner;

an exhaust opening in the top wall of the firebox;

a catalytic converter positioned in the exhaust opening of the firebox and forming a secondary combustion chamber; and whereby exhaust products from the primary combustion chamber are received by the catalytic converter wherein secondary combustion takes place and the exhaust products from the secondary combustion chamber are received by the top room air plenum and are mixed with room air received by the rear room air plenum and exhausted into the room in which the fireplace is situated.

2. A fireplace as claimed in claim 1 wherein the fireplace operates with a substantial portion of yellow flame provided in the combustion chamber.

3. A fireplace as claimed in claim 2 wherein the exhaust from the primary combustion chamber comprises from about 2% to about 10% oxygen.

4. A fireplace as claimed in claim 1 wherein the fireplace operates with a converter temperature of at least about 200° C.

5. A fireplace as claimed in claim 1 wherein the fireplace operates with a catalytic converter temperature of at least about 240° C.

6. A gas log fireplace comprising:

a housing having a top wall, bottom wall, side walls and a rear wall;

a firebox within the housing comprising a top wall, rear wall and side walls, said firebox forming a primary combustion chamber;

a room air plenum comprising a top room air plenum between the top wall of the firebox and the top wall of the housing, a rear room air plenum between the rear wall of the firebox and the rear wall of the housing in communication with the top room air plenum;

an inlet opening for allowing room air to enter the rear room air plenum;

an outlet opening in communication with the top room air plenum for allowing room air and exhaust products in the top room air plenum to be exhausted into a room in which the fireplace is situated;

an intake opening into the firebox for receiving room air into the primary combustion chamber;

a burner within the firebox and at least one artificial log within the firebox adjacent to said burner;

a gas outlet delivering combustible gas to the burner;

an exhaust opening in the top wall of the firebox;

a catalytic converter positioned in the exhaust opening of the firebox and forming a secondary combustion chamber; and whereby exhaust products from the primary combustion chamber are received by the catalytic converter wherein secondary combustion takes place and the exhaust products from the secondary combustion chamber are received by the top room air plenum and are mixed with room air received by the rear room air plenum and exhausted into the room in which the fireplace is situated.

7. A heating appliance comprising:

a housing;

a firebox within the housing;

an air pathway between an interior surface of the housing and an exterior surface of the firebox;

an inlet opening for allowing room air to enter the air pathway;

an outlet opening for allowing air in the air pathway to exit the air pathway;

an intake opening into the firebox for receiving room air;

a burner within the firebox and at least one artificial log within the firebox adjacent to said burner, the at least one log being viewable from the room where the appliance is located; and a catalytic converter in communication with the firebox, the catalytic converter having an input and an exhaust wherein the catalytic converter input receives exhaust products generated by the firebox and does not receive air from the air pathway, and wherein at least a portion of by-products exhausted from the catalytic converter are received in a room where the appliance is located.

8. An appliance as recited in claim 7 wherein the catalytic converter exhaust is in communication with the air pathway.

9. A heating appliance comprising:

a housing;

a firebox within the housing;

an air pathway between an interior surface of the housing and an exterior surface of the firebox;

an inlet opening to the air pathway;

an outlet opening in the air pathway and in communication with a room where the appliance is located;

a burner within the firebox and at least one artificial log within the firebox adjacent to said burner; and a catalytic converter in communication with the firebox, the catalytic converter having an input and an exhaust, wherein the catalytic converter exhaust is in communication with the air pathway, wherein the catalytic converter input receives exhaust products generated in the firebox and does not receive air from the air pathway.

* * * * *